United States Patent [19]

Jones et al.

[11] Patent Number: 4,573,828

[45] Date of Patent: Mar. 4, 1986

[54] ROOF SUPPORT SUITABLE FOR USE IN MINES

[75] Inventors: Michael D. Jones, Worcester; James B. Longford, Gloucester, both of England

[73] Assignee: Dowty Mining Equipment Limited, England

[21] Appl. No.: 596,254

[22] Filed: Apr. 3, 1984

[30] Foreign Application Priority Data

Apr. 29, 1983 [GB] United Kingdom ..... 8311825

[51] Int. Cl.[4] ..... E21D 15/44; E21D 17/08

[52] U.S. Cl. ..... 405/293; 405/291

[58] Field of Search ..... 405/291, 293, 294, 295, 405/296, 298, 299; 91/170 MP; 299/33

[56] References Cited

U.S. PATENT DOCUMENTS

| | | | |
|---|---|---|---|
| 3,431,737 | 3/1969 | Bower | 405/293 |
| 3,466,875 | 9/1969 | Groetschel | 405/293 |
| 4,266,892 | 5/1981 | Maykemper | 405/293 |

*Primary Examiner*—David H. Corbin

*Attorney, Agent, or Firm*—Hayes, Davis & Soloway

[57] ABSTRACT

A roof support, suitable for use in mines, includes a floor-engaging structure, extendible and contractible prop means carried by that structure, and a roof-engageable canopy supported by the prop means. The canopy comprises a main portion and an extension portion, each of which includes a plate member the upper face of which is engageable with the roof. Fastening means, which are provided for rigidly connecting the extension portion and the main portion together, include at least one connecting member adapted to lie within the thickness of the plate members, or substantially so.

11 Claims, 9 Drawing Figures

ROOF SUPPORT SUITABLE FOR USE IN MINES

Figure 1:
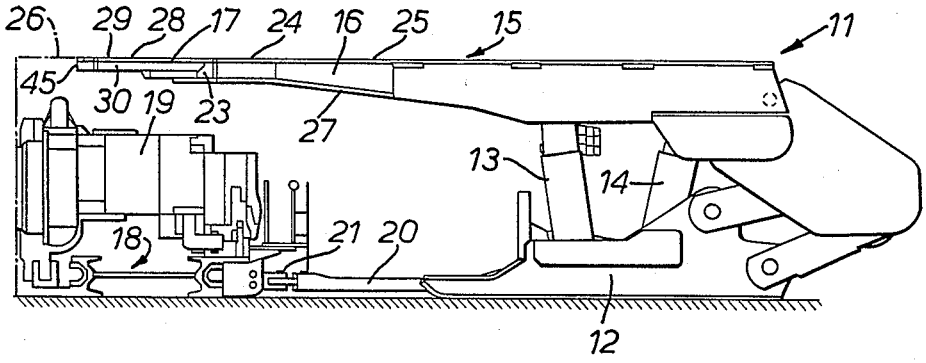

This invention relates to roof supports suitable for use in mines for supporting the mine roof during mineral-mining operations.

Such a roof support which can be of self-advancing type, includes a floor-engaging structure, extendible and contractible prop means carried by said structure, and a roof-engageable canopy supported by the prop means.

In certain cases the canopy is provided with a front extension portion suitably fitted to the main portion of the canopy to enable the distance between the tip of the canopy and the mineral face being worked to be at a suitable value when the support itself is operated in different ways. For example, when such an extension portion is fitted a wider walk-way between associated conveyor equipment and forward prop means of the support would be provided than when no extension portion is fitted.

Due to the high loading experienced on the tip of such a canopy extension portion when in supporting engagement with the mine roof, the bending moment transmitted by the joint between the extension portion and the main portion of the canopy is high. This, hitherto, has in practice necessitated a thick beam section at the joint to bring the tensile loads in the upper part of the canopy to levels amenable to normal joint fastenings. Such thick beam sections have been undesirable because they have taken up valuable space on the underside of the canopy. This has undesirably limited the available space for access and for the passage of associated equipment which is particularly disadvantageous in those roof supports intended for use in mines having relatively thin mineral seams. Also when the extension portion is removed the main portion of the canopy may be left with a relatively blunt forward tip which is disadvantageous particularly during support advancing operations.

The invention as claimed is intended to provide a remedy. It solves the problem of how to design an improved roof support intended to overcome the above-mentioned problems.

According to this invention a roof support, suitable for use in mines, includes a floor-engaging structure, extendible and contractible prop means carried by said structure, a roof-engageable canopy, supported by said prop means, which comprises a main portion and an extension portion each of which includes a plate member the upper face of which is engageable with the roof, and fastening means for rigidly connecting said extension portion and said main portion together, said fastening means including at least one connecting member adapted to lie within the thickness of the plate members, or substantially so.

Preferably said fastening means include a plurality of said connecting members each of which is retained with respect to said main portion and said extension portion by associated retention means.

The shape of said connecting member may be of dumb-bell profile or other suitable shape and is preferably of a material having a tensile strength significantly higher than that of said plate members.

The advantages offered by the invention are mainly that the thickness of the canopy in the region of the joint between the main portion and the extension portion thereof is considerably reduced, and an improved means is provided for readily securing, and for ready release of, the extension portion with respect to the main portion.

Figure 2:
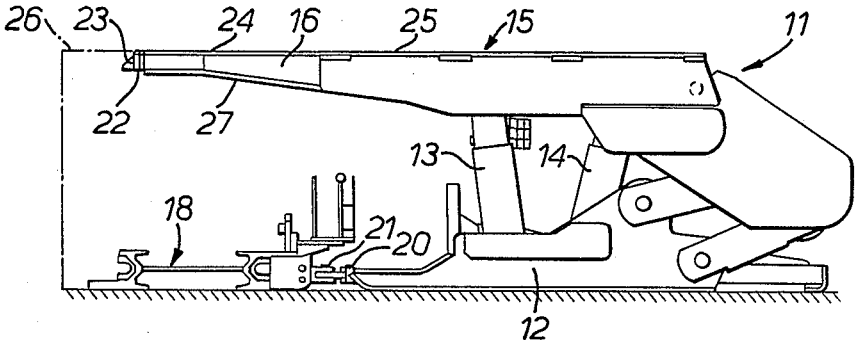
Figure 3:
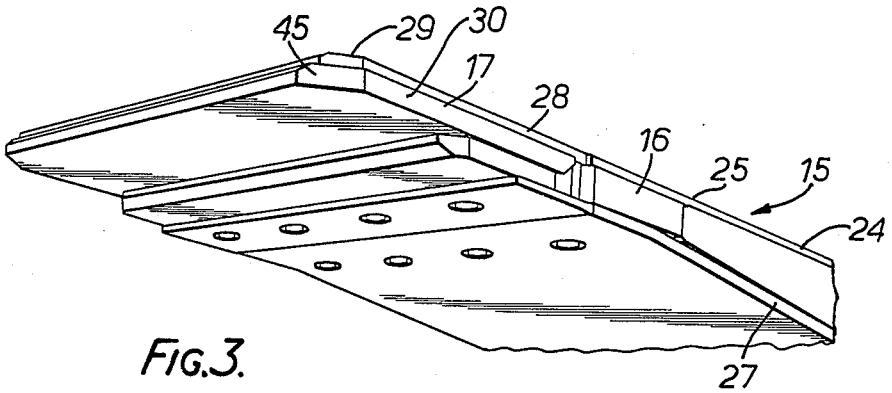
Figure 4:
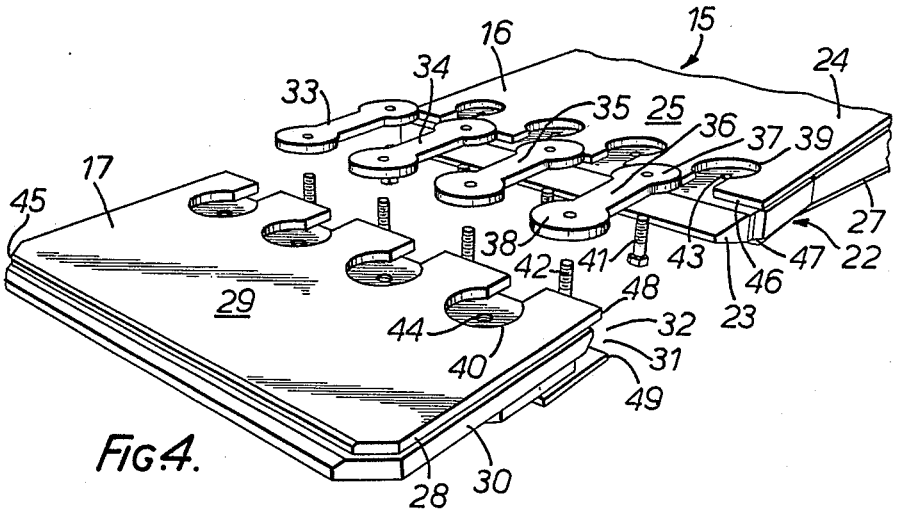
Figure 5:
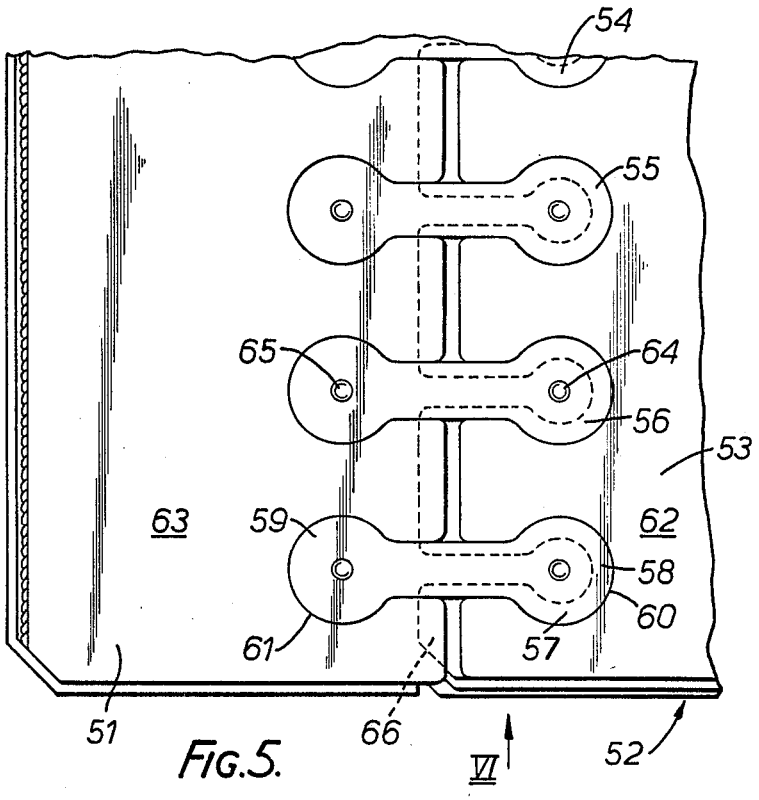
Figure 6:
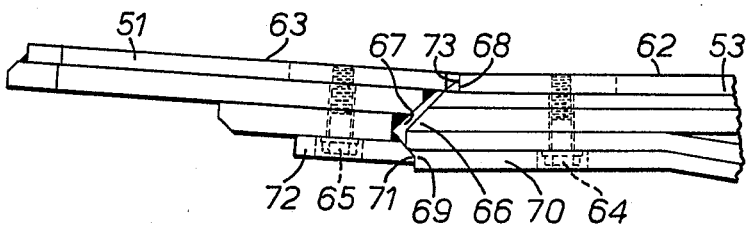
Figure 7:
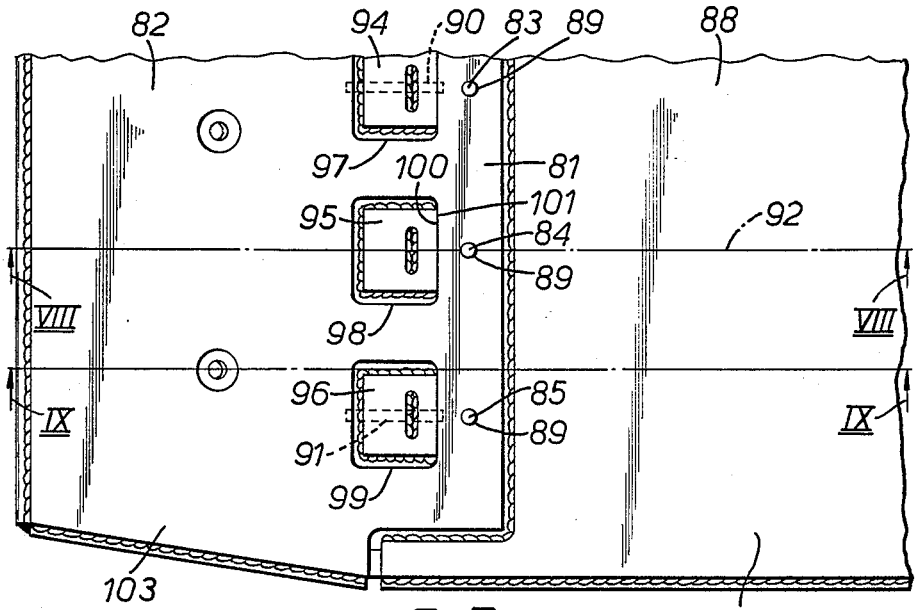
Figure 8:
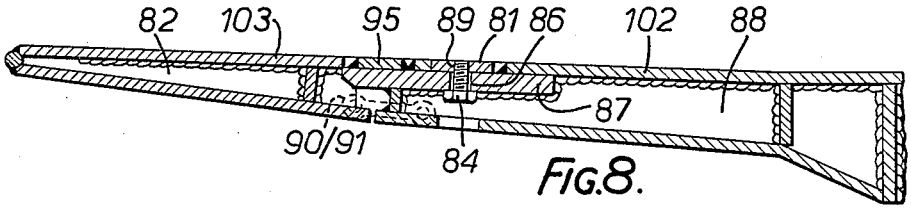
Figure 9:
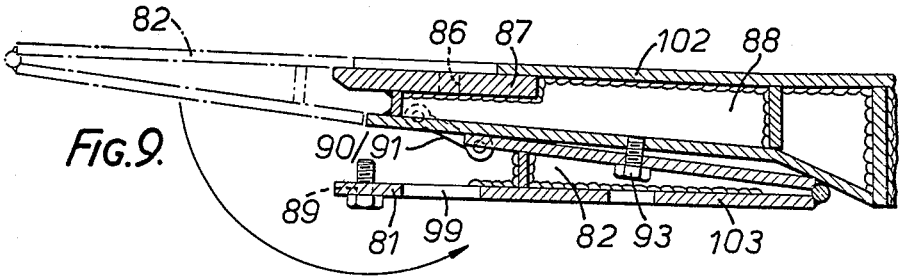

Three ways of carrying out the invention are described in detail below with reference to the drawings which illustrate three specific embodiments, in which:

FIG. 1 is a side elevation of a mine roof support in accordance with the first embodiment of the invention and with a canopy extension portion fitted, FIG. 2 is a view similar to that of FIG. 1 but with the canopy extension portion removed, FIG. 3 is a perspective view of part of the roof support shown in FIG. 1 with the extension portion of the canopy fitted to the main portion thereof, FIG. 4 is another perspective view, but in exploded form, of the part of the roof support shown in FIG. 3 with the extension portion removed from the main portion of the canopy, FIG. 5 is a plan view of part of the roof-engageable canopy of a mine roof support in accordance with the second embodiment of the invention, FIG. 6 is a view taken in the direction of the arrow VI on FIG. 5, FIG. 7 is a plan view of part of the roof-engageable canopy of a mine roof support in accordance with the third embodiment of the invention, FIG. 8 is a cross-section taken along the line VIII—VIII on FIG. 7, and FIG. 9 is a cross-section taken along the line IX—IX on FIG. 7 but with the extension portion shown in full lines in a folded condition.

With reference to FIGS. 1 to 4 of the drawings the support 11 of the first embodiment, which is intended for use in a mine for supporting the mine roof during mineral-mining operations, comprises a mine-floor-engaging structure in the form of a floor beam 12, two pairs 13, 14 of hydraulically extendible and contractible props carried by the beam 12, and a roof-engageable canopy 15 supported by the props. The canopy comprises a main portion 16 to which an extension portion 17 can readily be fitted.

A scraper-chain conveyor associated with the roof support is shown at 18 and mineral cutting equipment 19 is carried in conventional manner on this conveyor. The support is of self-advancing type, a relay bar 20 which forms part of the self-advancing apparatus for the support being shown connected at 21 to the conveyor.

The forward tip 22 of main portion 16 is not blunt but is formed with a tongue 23 generally of triangular cross-section so that when extension portion 17 is not fitted to the support the generally triangular profile of tip 22 provides a suitable ramp to facilitate advance of the support.

The main portion 16 includes an upper plate member 24 the upper face 25 of which is engageable with mine roof 26. Portion 16 also includes a lower plate member 27. The extension portion 17 includes an upper plate member 28 the upper face 29 of which is also engageable with roof 26. Portion 17 also includes a lower plate member 30.

When extension portion 17 is fitted to main portion 16, tongue 23 engages a groove 31 of complementary cross-sectional shape formed in the rearward end face 32 of portion 17. Also, as shown in the drawings, when so fitted main portion 16 is disposed immediately adjacent extension portion 17 to provide smooth, substantially uninterrupted, transition from upper face 25 to upper face 29.

Fastening means, for affording ready and rigid attachment of portion 17 to main portion 16 and for affording ready detachment of the extension portion from the main portion, include four parallel connecting or link members 33, 34, 35, 36 disposed lengthwise of the canopy. These connecting members are of dumb-bell shape in profile and their thickness is substantially the same as that of each of the upper plate members 24, 28 so that they lie within the thickness of those plate members, or substantially so. The enlarged end portions 37, 38 of each of the connecting members fit into respective cut-away portions 39, 40 of complementary shape provided in the plate members 24, 28. Retaining bolts 41, 42, which respectively pass with substantial clearance through suitable apertures 43, 44 in portions 16 and 17, are screw-threadedly engaged with the respective end portions 37, 38 of their respective connecting member. The bolts 41, 42 thus form associated retention means to prevent connecting members 33–36 from moving upwardly inadvertently out of the seatings formed by portions 39, 40.

The bending moment between the forward tip 45 of the extension portion 17 and the main portion 16 of the canopy is by this construction mainly carried by the upper and lower plate members 24, 28; 27, 30. The connecting members 33–36 which are of substantially the same thickness as the upper plate members and which are of a material having a tensile strength significantly higher than that of the plate members, provide a very reliable connection between main portion 16 and extension portion 17. Further, the higher tensile strength of the material of the connecting members enables the cut-outs in the plates to be reduced.

The connecting members may be designed to permit any of a suitable range of extension portions to be fitted to the main portion of the canopy as desirable in dependence upon installational requirements.

Instead of arranging for portion 17 to be susbstantially in line with portion 16 in the manner shown in FIGS. 1, 3 and 4 with faces 46, 47; 48, 49 engaging in a vertical plane, in the second embodiment of the invention shown in FIGS. 5 and 6 the construction is somewhat different. Here extension portion 51 of canopy 52, when fitted, is tilted upwardly with respect to main portion 53.

As with the first embodiment connecting or link members 54, 55, 56, 57 of dumb-bell shape in profile are provided, the enlarged end portions 58, 59 of each fitting into cut-away portions 60, 61 of complementary shape provided in the upper plate members 62, 63 of main portion 53 and extension portion 51 respectively. Also members 54–57 lie within the thickness of plate members 62, 63, or substantially so. Again, bolts, as at 64, 65, serve as retention means for members 54–57.

The main portion 53 is provided with a tongue 66 which fits into groove 67. The forward end face 68 of upper plate member 62 of the main portion is set back further rearwardly than the forward end face 69 of the lower plate member 70 of the main portion. Also the rearward end face 71 of the component 72 is set further forward than the rearward end face 73 of upper plate member 63 of the extension portion. Thus, when the extension portion 51 is fitted to the main portion 53 of the canopy, faces 68, 73; 69, 71 engage in such planes as to provide the extension portion with the required upwardly tilting attitude with respect to the main portion.

With reference now to FIGS. 7, 8 and 9, in the third embodiment of the invention a single connecting member 81 is provided which is formed integrally with extension portion 82 of the roof-engageable canopy. This member projects lengthwise of the canopy and extends transversely for almost the full width of portion 82. Three bolts 83, 84, 85 pass upwardly through clearance apertures 86 formed in plate 87 which is itself fast with main portion 88. These bolts are screw-threadedly engaged with threaded apertures 89 formed in member 81 and thereby rigidly connect extension portion 82 to main portion 88.

When it is required to fold the extension portion 82 from its aligned position with main portion 88 as shown in FIG. 8 to a stowed position beneath the main portion as shown in FIG. 9, the bolts 83, 84, 85 are unscrewed so that the single connecting member 81 is disconnected from main portion 88. However, in this construction extension portion 82 remains connected to main portion 88 by two further connecting members in the form of links 90, 91. These links, which are slotted at each end for pivotal connection to the main portion and to the extension portion, are equi-spaced on either side of the longitudinal axis 92 of portions 82, 88. The links permit the extension portion to swing downwardly on release of bolts 83, 84, 85, and as shown in FIG. 9 this portion can then be swung upwardly to its stowed position immediately adjacent the underside of main portion 88. A bolt 93 is fitted as shown to hold the extension portion in this position.

With the extension portion so stowed the overall length of the support is substantially reduced and this facilitates transportation of the support both in the mine and outside the mine.

In the construction of this third embodiment pads 94, 95, 96 are welded to the upper surface of plate 87 and these register with respective windows 97, 98, 99 cut in the connecting member 81. The pads are so set on plate 87 that when the connecting member 81 is secured to main portion 88 by bolts 83, 84, 85, the rearward face 100 of each pad is in load-bearing engagement with the rearward face 101 of its respective window.

As with the connecting members of the first two embodiments above described with reference to the drawings, the connecting member 81 lies within the thickness, or substantially so, of the roof-engageable plate members 103, 102 of extension portion 82 and main portion 88 and is of a material having a tensile strength significantly higher than that of those plate members.

In alternative embodiments of the invention provision may be made for modifying the degree of upward tilt of the extension portion by the fitment of suitably-shaped wedges or the like between the co-operable end faces of the main portion and extension portion.

Although in the embodiments above described with reference to the drawings the retention means associated with the connecting members have been in the form of bolts, in alternative embodiments other suitable means may instead be provided.

Further, although in the first two embodiments above described with reference to the drawings the connecting members have been of dumb-bell shape in profile, in alternative embodiments of the invention these members may be of different shape, for example their end portions may be of dovetail or other suitable form.

Again, although in the first two embodiments above described with reference to the drawings the connecting members are removable from the cut-away portions in both the main portion and the extension portion of the canopy, in alternative embodiments of the invention each connecting member may be permanently secured, for example as by welding, at one end thereof to the main portion of the canopy, or, alternatively to the extension portion thereof.

Finally, although in the third embodiment above described with reference to the drawings the single connecting member is formed integrally with the extension portion, in alternative embodiments of the invention a single connecting member may instead be formed integrally with the main portion of the canopy. Also, in other embodiments a plurality of connecting members may be formed integrally with the main portion of the canopy, or, alternatively, with the extension portion thereof.

We claim:

1. A roof support, suitable for use in mines, including a floor-engaging structure, extendable and contractible prop means carried by said structure, a roof-engageable canopy, supported by said prop means, which comprises a main portion and an extension portion each of which includes a respective upper plate member and a respective lower plate member, the upper faces of the two upper plate members being engageable with the roof, and fastening means for rigidly connecting said extension portion and said main portion together, the one immediately adjacent the other to provide smooth, substantially uninterrupted, transition from one said upper face to the other, said fastening means including at least one connecting member adapted to lie at least substantially within the thickness of said upper plate members.

2. A support as claimed in claim 1, wherein said fastening means include a plurality of said connecting members each of which is retained with respect to said main portion and said extension portion by associated retention means.

3. A support as claimed in claim 1, wherein the or each said connecting member is of dumb-bell profile.

4. A support as claimed in claim 3, wherein the enlarged end portions of the or each said connecting member of dumb-bell profile fit into respective cut-away portions of complementary shape provided in said plate members.

5. A support as claimed in claim 2, wherein said retention means comprise bolts which are screw-threadedly engageable with said connecting members.

6. A support as claimed in claim 1, wherein said connecting member is formed integrally with one of said main portion and said extension portion and is secured to the other thereof by associated retention means.

7. A support as claimed in claim 1, wherein one said connecting member is provided which is formed integrally with said extension portion and which extends for a substantial portion of the width thereof, retention means suitably passing through said main portion and engaging said connecting member to effect rigid connection of said extension portion to said main portion.

8. A support as claimed in claim 1, wherein the or each said connecting member is of a material having a tensile strength higher than that of said plate members.

9. A support as claimed in claim 2, wherein at least one further connecting member is so fitted to said main portion and to said extension portion that when certain at least of said retention means, and thus the associated said connecting member or connecting members, are released, said extension portion can be folded with respect to said main portion to a stowed position immediately beneath said main portion.

10. A support as claimed in claim 9, wherein the or each said further connecting member comprises a link which is slotted at each end for pivotal connection to said main portion and to said extension portion.

11. A roof support, suitable for use in mines, including a floor-engaging structure, extendable and contractible prop means carried by said structure, a roof-engageable canopy, supported by said prop means, which comprises a main portion and an extension portion each of which includes a respective upper plate member and a respective lower plate member, the upper faces of the two upper plate members being engageable with the roof, and fastening means for rigidly connecting said extension portion and said main portion together, the one immediately adjacent the other to provide smooth, substantially uninterrupted, transition from one said upper face to the other, said fastening means including at least one connecting member which is adapted to lie at least substantially within the thickness of said upper plate members and which is of a material having a tensile strength higher than that of said plate members.

* * * * *